US005095732A

United States Patent [19]

Bootka

[11] Patent Number: 5,095,732

[45] Date of Patent: Mar. 17, 1992

[54] CRIMPING TOOL FOR VEHICLE DOOR PANELS

[75] Inventor: Tony Bootka, Independence, Mo.

[73] Assignee: George Becker, Belton, Mo. ; a part interest

[21] Appl. No.: 567,615

[22] Filed: Aug. 15, 1990

[51] Int. Cl.[5] ..... B21D 5/01

[52] U.S. Cl. ..... 72/409; 81/420; 29/243.58

[58] Field of Search ..... 72/409, 414; 29/243.58, 29/243.57; 81/418, 420, 421

[56] References Cited

U.S. PATENT DOCUMENTS

| | | | |
|---|---|---|---|
| 1,983,519 | 12/1934 | Choate | 72/409 |
| 2,572,738 | 10/1951 | Lovinggood | 72/409 |
| 3,180,128 | 4/1965 | Faulkner | 72/409 |
| 3,330,147 | 7/1967 | Wieters | 72/409 |
| 3,602,032 | 8/1971 | Skintzis | 29/243.58 |
| 3,961,518 | 6/1976 | Osbolt | 72/409 |
| 4,318,211 | 3/1982 | Hoskinson | 29/243.58 |
| 4,926,536 | 5/1990 | Kohut | 72/409 |

FOREIGN PATENT DOCUMENTS

| | | | |
|---|---|---|---|
| 697377 | 1/1931 | France | 72/409 |
| 998546 | 1/1952 | France | 81/418 |

*Primary Examiner*—Daniel C. Crane

*Attorney, Agent, or Firm*—Kokjer, Kircher, Bowman & Johnson

[57] ABSTRACT

A tool for manually crimping a flanged vehicle door panel onto a door frame without the need to remove the door from the vehicle body. The tool includes a pair of levers having a slip joint pivot connection. The jaw of one lever carries a crimping head that can be slipped through the gap between the hinged edge of the vehicle door and the adjacent fender panel. The other jaw carries a backing head which opposes the crimping head when the levers are squeezed together to close the jaws in order to effect crimping of the door panel.

7 Claims, 1 Drawing Sheet

CRIMPING TOOL FOR VEHICLE DOOR PANELS

BACKGROUND AND SUMMARY OF THE INVENTION

This invention relates generally to vehicle body work and more particularly to a hand held tool which is used to crimp the flanged edge of a vehicle door panel onto the door frame while the door frame remains hinged to the vehicle body.

During the process of repairing damaged doors of automobiles and other vehicles, it is necessary to place the door panel or skin on the door frame and then crimp the panel edge onto the frame. The edge of the door panel is normally flanged so that the flange can be crimped to the frame in order to secure the panel in place.

At present, it is necessary for the entire door frame to be removed from the vehicle in order to provide enough room for crimping of the door panel onto the edge of the frame which is hinged to the vehicle body. There have not been tools available that allow the door panel to be crimped to the hinged edge of the frame, primarily because of the space limitations that are presented at the junction between the fender panel and the door panel. Considerable time and labor are required to remove and replace the entire door under the best of conditions. In recent years, this problem has been compounded by the trend for larger numbers of wires to be extended to the door. Power operated door locks and windows must be wired through the hinges to the doors, and the same is true for the wiring of other equipment such as audio systems. In order to remove and replace the door, all of the wiring that extends through the hinges must be disconnected and then reconnected when the door is replaced, and this greatly complicates the job of door panel repair.

It is thus evident that automobile door panel repair could be greatly simplified and made more economical by the provision of a tool that is able to crimp a door panel without the need to remove the door. The present invention provides such a tool and thus represents a significant practical improvement in the field of vehicle body repair.

In accordance with the invention, a manual crimping tool includes two hand levers that have handles at one end and jaws at the other end. The levers are connected near their jaw ends by a slip joint pivot connection. One jaw carries an L-shaped crimping head which may be fitted through the thin gap between the hinged side of the door and the adjacent fender panel. The other jaw carries a backing head which is brought against the exterior surface of the door panel in opposition to the crimping head. When the handles are then squeezed to close the jaws, the crimping tab on the crimping head bends the flanged edge of the door panel and crimps it onto the door frame. At the same time, a flat backing plate on the backing head presents a large surface which spreads out the crimping force and thus minimizes marring of the visible surface of the door panel.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
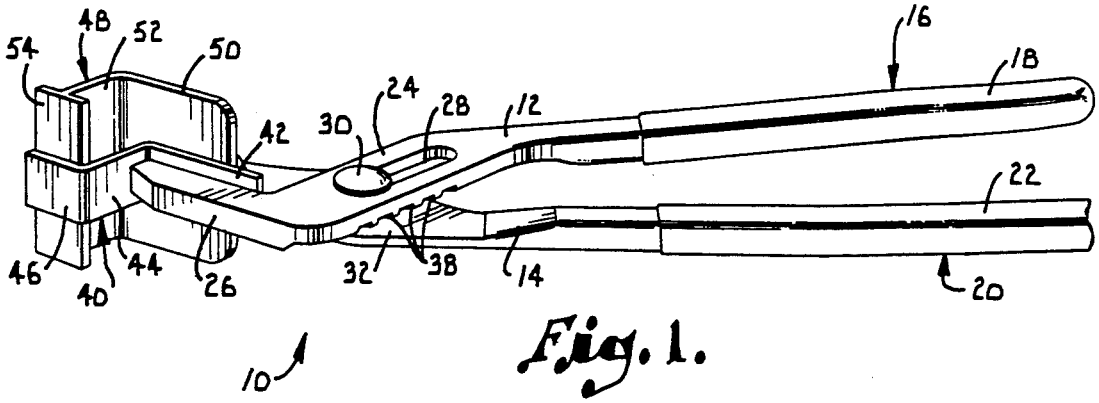
FIG. 1 is a perspective view of a crimping tool constructed according to a preferred embodiment of the present invention, with the jaws of the crimping tool closed.

Referring now to the drawings in more detail, numeral 10 generally designates a crimping tool which is used to crimp a door panel or skin onto a door frame of a vehicle. The crimping tool 10 includes two hand levers 12 and 14. Lever 12 has at one end a handle 16 on which a suitable hand grip 18 is slipped. The other lever 14 similarly has a handle 20 at one end equipped with a hand grip 22.

Lever 12 has an intermediate portion 24 which is oriented at an angle relative to the handle 16. The end of lever 12 opposite the handle end carries a jaw 26 which projects from portion 24. The intermediate portion 24 is provided with an elongated slot 28. A pivot fastener 30 is secured to an intermediate portion 32 of the other lever 14, and the fastener 30 also extends through the slot 28. A jaw 34 is provided on the end of lever 14 opposite the handle end.

The fastener 30 and slot 28 provide a pivotal slip joint which connects the two levers 12 and 14. The levers may be pivoted about the axis of the fastener 30 in order to move the jaws 26 and 34 toward and away from one another in a pivotal fashion. At the same time, the slot 28 provides a slip joint which permits lever 12 to slip linearly relative to the coupling 30 in order to adjust the positions of the two jaws relative to one another. An arcuate rib 36 is provided on the intermediate portion 32 of lever 14, and the rib 36 may be fitted in any one of a number of arcuate grooves 38 which are formed in the intermediate portion 24 of the other lever 12. When the jaws of the tool are being closed, the close fit of the rib 36 in one of the grooves 38 locks against slippage so that the slip joint will not slip while the jaws are being closed.

In accordance with the present invention, a crimping head generally identified by numeral 40 is carried on the jaw 26. A base 42 is welded or otherwise secured to the inside edge of jaw 26, and the crimping head 40 is an L-shaped structure which extends from the base 42 and which includes a leg 44 and a flat crimping tab 46. The leg 44 is formed integrally on the end of the base 42 and extends beyond the tip of the jaw 26. The crimping tab 46 extends from the leg 44 and is perpendicular to it.

Opposing the crimping head 40 is a T-shaped backing head which is generally identified by numeral 48 and which is mounted on the other jaw 34. A flat base plate 50 is welded or otherwise secured to the inside edge of jaw 34. A leg 52 of the backing head 48 extends integrally from the end of the base plate 50 and carries on its free end a flat backing plate 54. It is noted that when the jaws 26 and 34 are closed, the legs 44 and 52 are generally parallel and the crimping tab 46 is generally parallel to the backing plate 54. It is also noted that the surface area of the backing plate 54 is considerably greater than the surface area of the crimping tab 46. Preferably, the surface area presented by the backing plate 54 is about three times as great as the surface area presented by the crimping tab 46.

In use, the crimping tool 10 serves to crimp a door panel skin 56 onto a door panel frame 58. The door frame 58 has a flange 60 on its edge, and the edge of the door panel 58 likewise has a flange 62 which is crimped onto flange 60 in order to secure the door panel 56 in place on the frame.

It is a particular feature of the present invention that the tool 10 can be used to crimp the hinged side of the door panel 56 onto the door frame 58 while the door frame remains hinged to the adjacent fender panel 64 of the vehicle. The fender panel 64 has a projecting surface 66, and there is a small gap 68 presented between the body of the door panel 56 and the body of the fender panel 64.

In use of the tool 10, the door panel 56 is first fitted onto the frame 58, and the three edges of the door panel exclusive of the hinged edge may be crimped onto the edge of the door frame, preferably with the tool 10. These three edges are relatively easy to crimp because the door can be swung open so that sufficient room is provided for the crimping operation. However, the hinged edge of the door is more difficult to crimp because only the thin gap 68 is present at this location.

Figure 2:
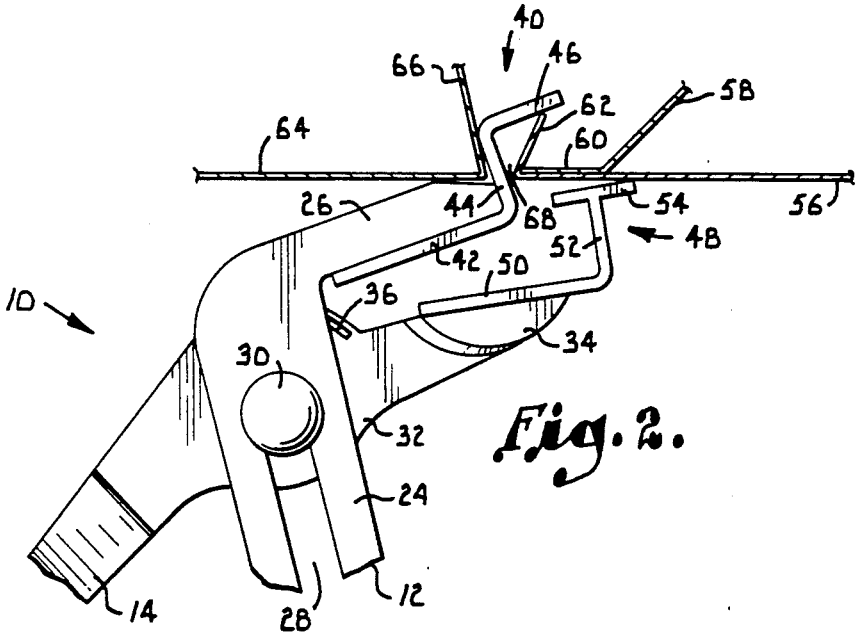
FIG. 2 is a fragmentary view showing application of the crimping tool to a door panel, with the jaws open and the crimping head of the tool extended through the gap between a vehicle fender panel and a door which is being repaired.

The tool 10 is used to crimp the hinged edge of the door with the jaws initially held open. The L-shaped crimping head 40 may be extended through the gap 68 with the tab 46 manipulated until it is adjacent to the edge of the flange 62 as shown in FIG. 2. The leg 44 of the crimping head extends through the gap 68, while the backing head 48 remains wholly on the exterior of the vehicle door. The presence of the slip joint permits the jaws 26 and 34 to be separated by a considerable distance when the crimping head 40 is inserted through the gap 68, and this minimizes inadvertent marring of the exterior surface of the door panel 56 due to scratching by the backing head 48.

Figure 3:
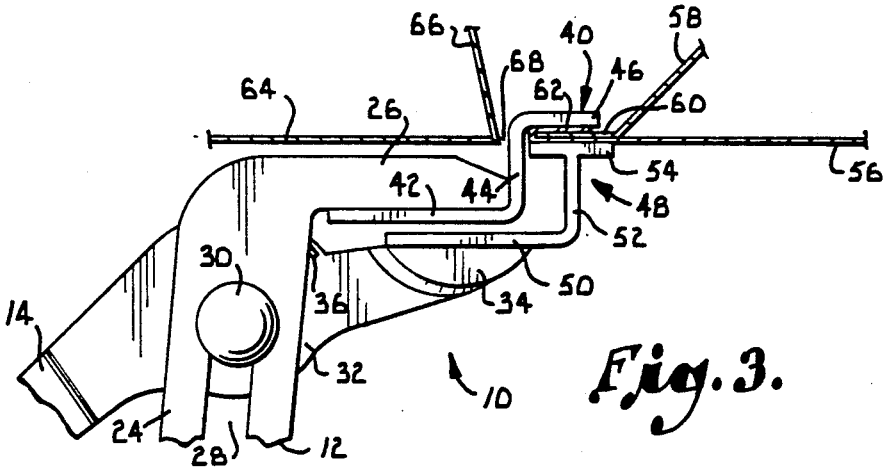
FIG. 3 is a fragmentary view similar to FIG. 3, but showing the jaws of the tool closed in order to crimp the flanged edge of the door panel onto the frame of the door.

After the crimping head 40 has been positioned as shown in FIG. 2, the slip joint is closed to its maximum extent, and the two hand grips 18 and 22 may be squeezed together in order to close the jaws 26 and 34. As this occurs, the crimping tab 46 works against the flange 62 on the edge of the door panel and crimps it onto and behind the door frame flange 60 as shown in FIG. 3. At the same time, the backing plate 54 of the backing head flatly contacts the exterior surface of the door panel and provides backing for the crimping action that is carried out by the tab 46.

Each time the jaws are closed in this fashion, a portion of the door panel flange 62 is crimped onto the door frame. The tool 10 can be moved incrementally along the length of the hinged edge of the door, and the process can be repeated until the entire hinged edge is crimped in place. It is noted that the relatively large surface area presented by the backing plate 54 results in spreading of the crimping force over a relatively large area on the exterior visible surface of the door panel. Spreading out of the forces in turn minimizes scratching or other marring of the visible portion of the door panel. When the crimping operation has been completed, the jaws should be opened, the slip joint should be slid to its maximum opening, and the crimping head 40 can then be withdrawn from the gap 68.

In this manner, the hinged edge of the door panel can be quickly and easily crimped onto the door frame edge without the need to remove the door from the body of the vehicle. This results in considerable cost and labor savings because there is no need to remove and replace the door and particularly no need to disconnect and reconnect the considerable wiring that typically extends through the door hinges of modern automobiles.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, I claim:

1. A tool for manually crimping a vehicle door panel having a flanged edge onto a door frame while the door frame remains hinged to and spaced by a gap from a body panel of the vehicle, said tool comprising:

first and second rigid levers each having a jaw on one end and a handle on another end, a length of each lever defined by the distance extending between distal ends of said one end and said other end, each lever being rigid throughout its length and said levers being arranged to criss cross one another;

a pivot connection for pivotally connecting said levers between the ends thereof for pivotal movement of the jaws toward and away from one another in response to movement of said handles toward and away from one another, respectively;

a rigid crimping head rigidly mounted on the jaw of said first lever and having a rigid base secured to the jaw, a leg extending from the base and a crimping tab extending from the leg and presenting a flat crimping surface, said leg being applicable through a gap to position said crimping surface of the tab against the flanged edge of the door panel and said leg and tab cooperating to provide an L-shape; and a backing head on the jaw of said second lever having a base secured to the jaw, a leg extending from the base and a flat backing plate carried on said leg, said plate being applicable to present a flat surface to the exterior of the door panel in opposition to said crimping surface of the tab to permit the flanged edge to be crimping onto the door frame when the jaws are pivoted together with said leg of the crimping head extended through the gap.

2. The tool of claim 1, wherein said backing plate presents a larger surface area than said crimping surface of the tab.

3. The tool of claim 1, wherein said leg and backing plate of the backing head cooperate to present a T-shaped configuration.

4. The tool of claim 1, wherein said pivotal connecting means comprises a slip joint which provides a sliding connection between said levers.

5. A tool for manually crimping a vehicle door panel having a flanged edge onto a door frame while the door frame remains hinged to and spaced by a gap from a body panel of the vehicle, said tool comprising:

first and second rigid levers each having a handle on one end and a jaw on the opposite end, a length of each lever defined by the distance extending between distal ends of said one end and said opposite end, each lever being rigid throughout its length, said levers criss crossing with one another at a pivot joint and being connected together at said pivot joint for pivotal movement of said jaws toward one another upon squeezing of said handles together and away from one another upon separation of said handles, said levers being rigid between said pivot joint and said jaws and said first lever being L-shaped between said pivot joint and the jaw thereof;

a crimping head rigidly mounted on the jaw of said first lever, said crimping head presenting an L-shaped configuration which includes a leg extending from the jaw and a crimping tab extending from the leg and presenting a flat crimping surface, said crimping head also including a base rigidly secured to said jaw of the first lever and having said leg extending rigidly therefrom;

a backing head on the jaw of said second lever, said backing head having a configuration which includes a base secured to the jaw, a leg extending from said base and a backing plate having a surface area greater than the surface area presented by said crimping surface of the tab; and said leg of the crimping head being extensible through the gap to position said crimping surface of the tab adjacent to the flanged edge of the door panel with said backing plate against the exterior of the door panel in opposition to said tab to effect crimping of the flanged edge of the door panel onto the door frame upon movement of the jaws toward one another in response to squeezing of the handles together.

6. The tool of claim 5, wherein said leg and backing plate of the backing head cooperate to present a T-shaped configuration.

7. The tool of claim 5, wherein said levers are connected in a slip joint permitting the levers to slide relative to one another.

* * * * *